US006712120B2

(12) United States Patent
Tiemann

(10) Patent No.: US 6,712,120 B2
(45) Date of Patent: Mar. 30, 2004

(54) DEVICE AND METHOD FOR CASTING A WORKPIECE AND WORKPIECE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 13 days.

(21) Appl. No.: 10/204,692

(22) PCT Filed: Jan. 31, 2001

(86) PCT No.: PCT/EP01/01014

§ 371 (c)(1),
(2), (4) Date: Aug. 23, 2002

(87) PCT Pub. No.: WO01/62414

PCT Pub. Date: Aug. 30, 2001

(65) Prior Publication Data

US 2003/0010469 A1 Jan. 16, 2003

(30) Foreign Application Priority Data

Feb. 25, 2000 (EP) ..... 00104001

(51) Int. Cl.[7] ..... B22D 33/04
(52) U.S. Cl. ..... 164/137; 164/397; 164/340
(58) Field of Search ..... 164/137, 132, 164/397, 340

(56) References Cited

U.S. PATENT DOCUMENTS 5,014,658 A * 5/1991 Hara et al. ..... 123/193.6
5,533,864 A * 7/1996 Nomoto et al. ..... 416/96 A
6,530,416 B1 * 3/2003 Tiemann ..... 164/137

* cited by examiner

*Primary Examiner*—Tom Dunn
*Assistant Examiner*—I. H. Lin
(74) *Attorney, Agent, or Firm*—Harness, Dickey & Pierce, P.L.C.

(57) ABSTRACT

A device for casting a workpiece, especially a turbine blade with inner cooling, includes a casting cavity in which casting cores which produce channels that pass through the workpiece are provided. There are no poorly cooled areas present in the workpiece. To this end, the casting cores are placed in the casting cavity in such a way that they rest against each other loosely.

4 Claims, 3 Drawing Sheets

DEVICE AND METHOD FOR CASTING A WORKPIECE AND WORKPIECE

This application is the national phase under 35 U.S.C. §371 of PCT International Application No. PCT/EP01/01014 which has an International filing date of Jan. 31, 2001, which designated the United States of America and which claims priority on European Patent Application No. 001 04 001.3 filed Feb. 25, 2000, the entire contents of which are hereby incorporated herein by reference.

FIELD OF THE INVENTION

The invention generally relates to a device for casting a workpiece. In particular, it relates to an internally cooled turbine blade or vane, having a casting cavity in which casting cores, which produce passages which pass through the workpiece, are present. Further, it generally relates to a process for casting a workpiece.

BACKGROUND OF THE INVENTION

Internally cooled turbine blades or vanes which arc exposed to hot gas are often cooled by what is known as film cooling. In film cooling, cooling air flows out of the interior of the blade or vane profile through bores. A film of air which has a cooling action forms on the outer side of the outer wall of the blade or vane profile. The bores are either cast in directly or arc drilled out at a later stage. To produce the cast bores, cylindrical casting cores, which are matched to the continuous passages, arc secured in the two casting-mold parts which form the inner and outer sides of the outer wall. Therefore, bores with a large bore diameter which lie a relatively long way apart are formed.

Consequently, there are relatively poorly cooled regions everywhere between the film-cooling bores. This fact is compensated for by using a greater flow of coolant than is actually required, in order for these relatively poorly cooled regions also to be sufficiently cooled.

SUMMARY OF THE INVENTION

An object of an embodiment of the present invention can be to propose a device for casting a workpiece without poorly cooled regions. In particular, it may be directed to casting a workpiece using internally cooled turbine blades or vanes, in order to create the possibility of sufficient film cooling with a low consumption of coolant. An object of an embodiment of the invention may be achieved by introducing casting cores into the casting cavity in such a manner that they rest loosely against one another.

The fact that the casting cores rest loosely against one another produces a dense packing of casting cores which differs according to the shape and size of the casting cores. Casting material which has been introduced is displaced at the points of contact between the casting cores. After casting, the casting-core material is removed from the material by chemical means, for example by leaching. Passages which pass through the workpiece and are virtually randomly distributed through the region which was filled with casting cores are formed, the channel density in a predetermined relationship with the casting-core density according to the size and shape of the casting cores.

The passages have openings on both sides of the workpiece. With the casting cores resting loosely against one another, virtually every casting core has at least one neighbor with which it is in contact. Further, the latter in turn has a further neighbor, and so on, until a casting core connected thereto is in contact with the other outer side of the workpiece.

In this way, it is possible for even casting materials which are able to withstand high temperatures to be processed for the production of film-cooled turbine blades or vanes, but also for cover plates and heat shields. The choice of a small size of casting core and a suitable shape of casting core produces a very large number of small channel outlet openings.

A passage which passes through the workpiece generally has a plurality of openings which lie closely together as outlets. If film cooling is used in a workpiece of this type, all regions of the surface, which is interrupted by openings of the passages, can be reached by the cooling film. At the same time, the workpiece which has passages passing through it is sufficiently strong, on account of the strong casting material but also on account of a specific choice of the shape and size of the casting cores, as will be explained in more detail below. Production of the casting device is simplified, since the casting cores which are introduced in this manner are supported against one another and therefore do not have to be secured separately in the surrounding casting-mold walls.

The fact that the casting cores are resting against one another indicates that, after casting, suitable passages with a small diameter at the passage opening are formed when at least two casting cores rest against one another producing a passage which passes through the workpiece.

If the maximum external dimensions of the casting cores are smaller than the minimum internal dimensions of the casting cavity, it is ensured that at least two or more casting cores can be distributed over the cross section of the casting cavity, in contact with one another, at any location in the casting cavity. In this way, it is possible to produce very small, branched passage structures depending on the size, shape and packing density of the casting cores.

The setting up of the casting mold as a whole is significantly simplified if the casting cores can be poured into the casting cavity. Even narrow, angular regions of the casting mold can in this way be occupied by the casting cores.

If the casting cores are approximately circular and/or ellipsoidal, they are easy to pour and are distributed well through the casting mold, without leaving large free spaces clear. The casting cores have a large surface area in order to produce contact locations with other, adjoining casting cores, so that a high passage density is produced in the cast workpiece. With ellipsoidal casting cores, it is possible in particular to produce elongate passage sections with a high passage density if the contact locations lie predominantly at the largest transverse dimensions of the ellipsoids.

If the casting cores are of approximately equal size, it is in this way possible to produce highly uniform passage structures which can be successfully predetermined.

If the diameters of the casting cores are between approximately 0.1 and approximately 2 mm, it is possible, in particular for standard turbine blade or vane wall thicknesses, to produce a number of passages which is sufficient for optimum film cooling. Therefore, the casting cores of this type are neither too small, which could entail casting problems, nor too large, meaning that cooling of the workpiece can only be achieved with a high level of coolant.

If the casting cores have hollows which can be filled with casting material, the workpiece is sufficiently strong despite its porous structure. On account of the hollows, the casting cores have a surface area which is large by comparison with its volume. Consequently, the proportion of casting material in the cast workpiece is increased.

If the hollow is a bore and runs through the center of the casting core, particularly good strength of the workpiece is produced even locally in the region of each core, since the casting cores are leached out after casting and in each case at least one central strut formed by the material remains in place, ensuring sufficient strength.

If only a predetermined part of the workpiece casting mold is filled with casting cores, part of the workpiece can be designed with passages and another part can be of solid design. This option can be used in particular in turbine blades or vanes as a result of the casting cores being introduced only into the region of the casting mold which produces the outer walls. In this case, only an outer wall has an open porosity, while the remainder of the blade or vane has the casting material in its original form. The outer wall can then be cooled by means of consumption-optimized film cooling. If the casting cores arc compacted using a vibratory device, it is possible to produce very narrow passage structures even with irregular casting cores. In this way, it is possible to correct uneven filling of the casting mold.

The casting cores can be prevented from floating up during casting if the casting cores which have been introduced into the casting cavity are held together.

If the casting cores are held together by meshes, on the one hand the casting cores are prevented from floating up during casting, and on the other hand, at the same time, it is possible to collect any slag materials which accumulate on the casting material. For this purpose, the mesh width must on the one hand be smaller than the diameter of the casting cores but on the other hand must be large enough to allow the slag materials to pass through.

Furthermore, the size of the passages can be adjusted if the casting cores which have been introduced into the casting cavity can subsequently be coated with a material which is able to withstand casting and bonds to them. The casting-resistant material bonds both to the surface and also in particular to the contact locations between two casting cores. In this way, these contact locations are reinforced and acquire a large diameter, which in turn influences the passage diameter. Furthermore, the applied material makes it possible to form additional contact locations if casting cores previously lay very close together but were not in contact with one another. Furthermore, the casting cores are held together better by the coating and the casting cores are prevented from floating up in the casting material.

If the casting mold is connected to an evacuation device, during casting the casting material is drawn even into the smallest cavities in the casting mold, in particular between the casting cores. The formation of regions which are free of casting material is avoided. Moreover, the casting operation is accelerated. The use of retaining devices, for example meshes, prevents casting cores from being drawn toward the evacuation device together with the casting material. To improve a casting process, it is proposed for casting cores to be introduced into the casting cavity in such a manner that they rest loosely against one another. This process produces, in a simple manner, continuous passages whose dimensions can easily be changed by suitable selection of the dimensions of the casting cores and the production of which does not require any complex preparation of the casting mold.

If the casting cores which have been introduced into the casting cavity are subsequently coated with a material which is able to withstand casting and bonds to them, they are held in the mold without it being necessary to use complex devices. Depending on the target size of the passages, the coating process can be repeated a number of times, in order in this way to improve cohesion between the cores or to produce new connections.

To improve a workpiece, it is proposed for passages to pass through the workpiece in the form of a three-dimensional grid. A workpiece of this type can be cooled sufficiently as a result of cooling air being passed through it on the other side even if the flow of cooling air is low. In the three-dimensional grid arrangement, the passages, the diameters of which vary as a function of the shape and arrangement of the casting cores, generally have multiple branches and a plurality of openings.

Very good workpiece properties are achieved if practically a quarter of the entire area of a workpiece side is made up of the area of uniformly distributed passage openings. On the one hand, there is then scarcely any location on a side of the workpiece which has passages passing through it which is relatively poorly cooled, since in the case of film cooling a well-cooled region which amounts to three times the width of the passage opening is formed behind the passage opening. Therefore, all regions of the workpiece side which has passages passing through it are cooled uniformly when the passage opening area forms a quarter of the total area. At the same time, the workpiece is sufficiently strong even in the region which has passages passing through it.

If the passage openings have diameters of between approximately 0.1 and approximately 2 mm, optimum cooling in particular of an outer wall, which has passages passing through it, of a conventional, internally cooled turbine blade or vane is ensured with film cooling.

BRIEF DESCRIPTION OF THE DRAWINGS

The figures show an exemplary embodiment of the invention. In the drawings.

DETAILED Description OF THE PREFERRED EMBODIMENTS

Figure 1A:
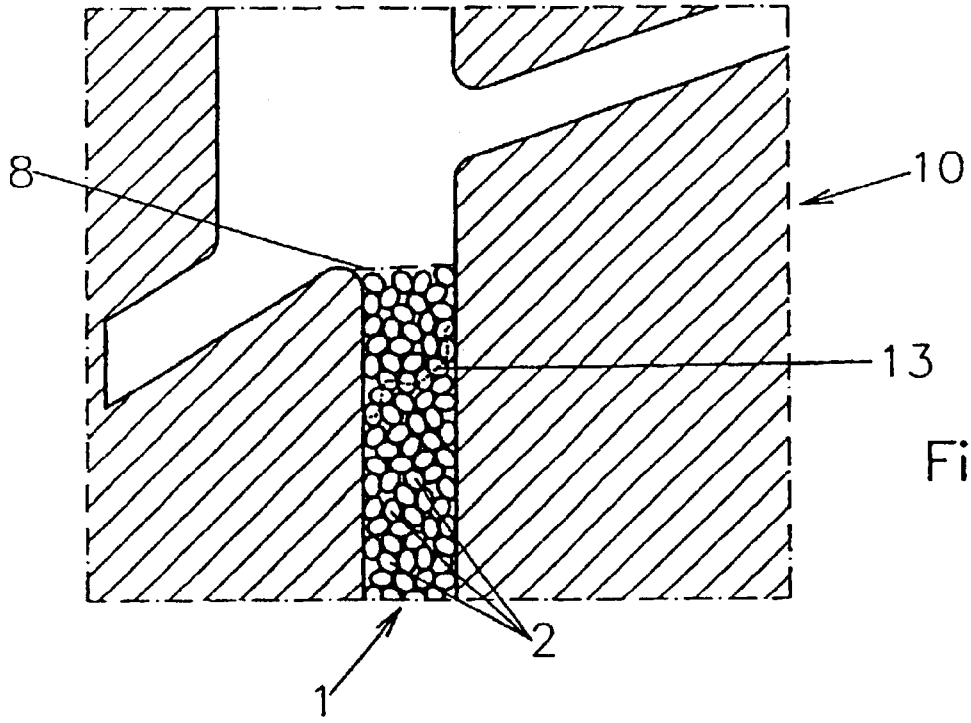
FIGS. 1*a, b* show sections through parts of a diagrammatically depicted casting mold for a turbine blade or vane, FIGS. 2*a, b, c* show perspective views of various casting cores.
Figure 3:
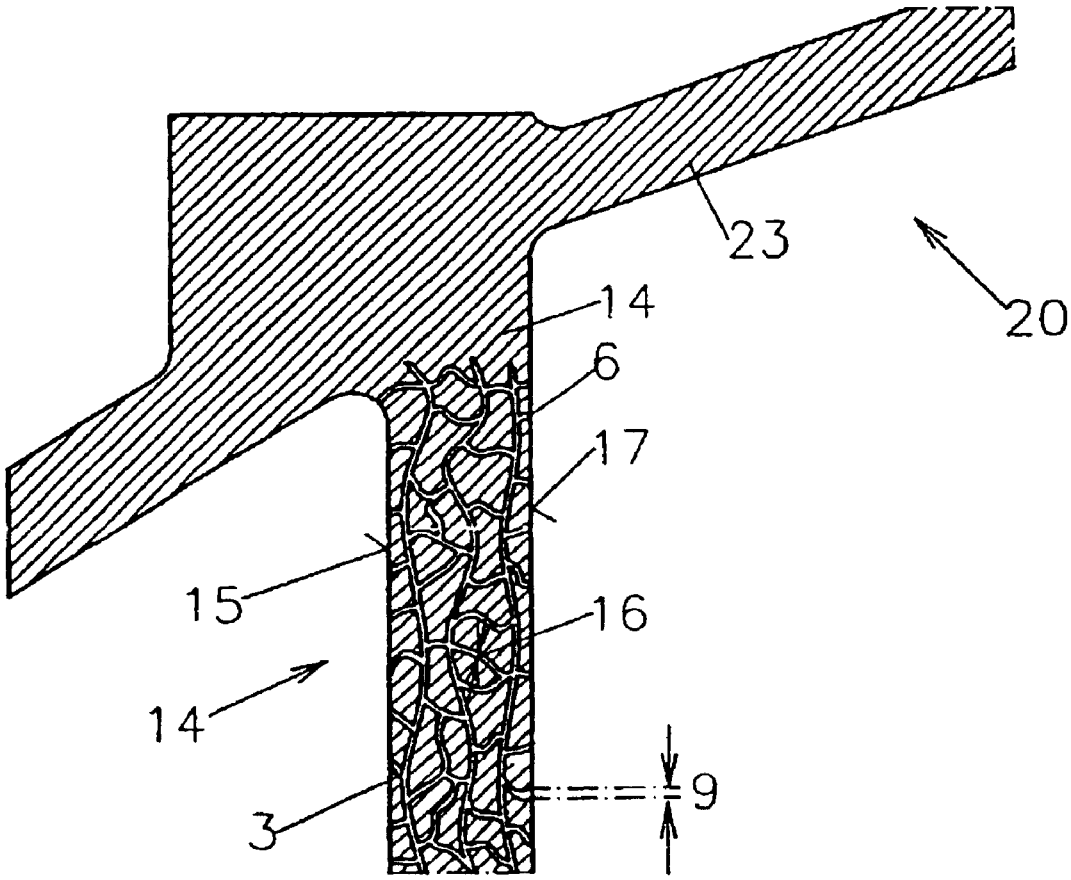
FIG. 3 shows a section through part of an outer wall, which has passages passing through it, of a turbine blade or vane.

FIG. 1*a* shows a section through part of a diagrammatic casting mold 10 for a turbine blade or vane. A casting cavity 1 is used for production of an outer wall 14 of an internally cooled turbine blade or vane, as illustrated in FIG. 3. The coolant is conveyed outward from an interior which has coolant flowing through it, through the outer wall 14, in such a way that the outer side 15 is covered by a film of coolant and is thereby cooled.

To produce passages 3 of this type, a large number of casting cores 2, which have been introduced into the casting cavity 1 in such a manner that they rest loosely against one another, is located in the casting cavity 1. To simplify the drawing, the casting cores 2 are all illustrated in section as being elliptical and of the same size, without further formations or hollows. More detailed illustrations of the casting cores 2 are to be found in FIGS. 2*a, b, c*.

The fact that the casting cores 2 are for the most part in contact with one another indicates that, after casting and subsequent chemical removal of the casting cores 2, passages 3 which pass through the workpiece are formed, as illustrated diagrammatically in FIG. 3. To prevent them from floating up or being introduced into other regions of the workpiece, the casting cores 2 are held together by means of a device, for example a mesh 8. In the exemplary embodiment, the casting cores 2 are of approximately the same size and ellipsoidal, almost spherical shape and lie very close together. They can be poured into the casting molds 10, making production easier.

For compacting purposes, it is possible to apply a vibratory device, which arranges the casting cores 2 even closer together under the force of gravity. The casting cores 2 are preferably produced from a standard casting-core ceramic, so that after the casting operation they can be leached out of the workpiece, provided that they are connected to the outer side 15 of the workpiece. Internal casting cores 2 which are completely surrounded by casting material can remain in the cast blank.

However, it is extremely unlikely that casting cores 2 will not be in contact with any other casting cores 2, since just one contact location per casting core 2 is generally sufficient to produce a connection from any desired location on one side of the outer wall all the way to the other side, as is diagrammatically indicated by the dashed line in FIGS. 1*a, b*. Therefore, after leaching passage systems with widespread branching are produced, allowing the coolant to pass through. The passage width 16 can be increased further by subsequent intensive etching.

Figure 1B:
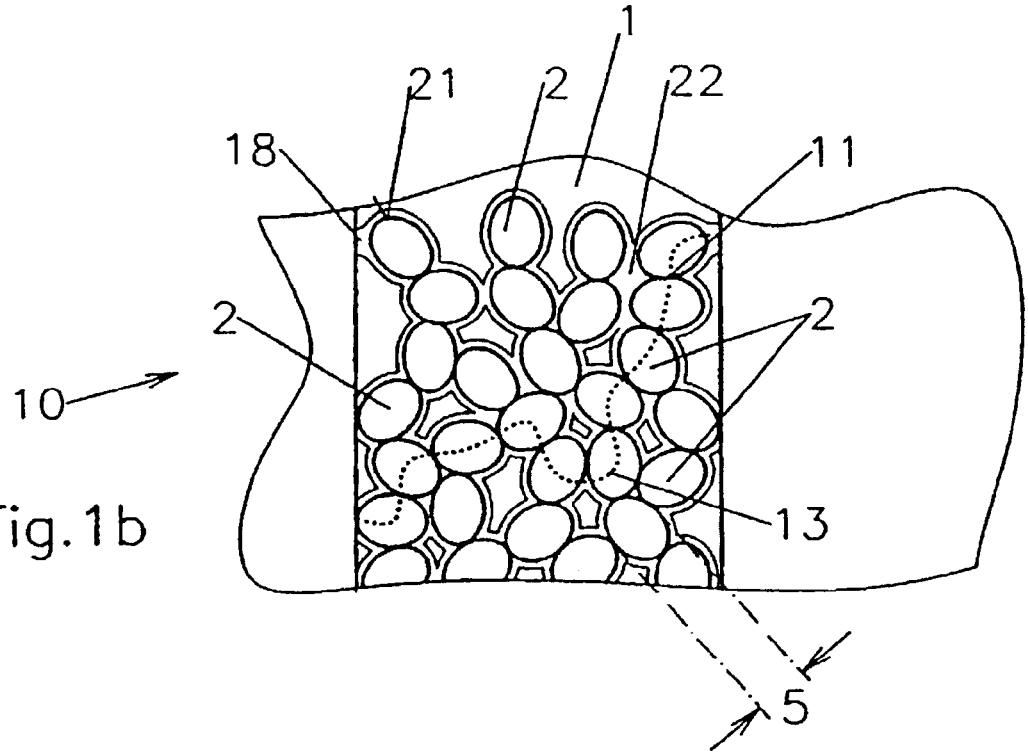

FIG. 1*b* diagrammatically depicts casting cores 2 which are arranged in a casting cavity 1 and, after they have been introduced into the casting mold 10, have been coated with a material which is able to withstand casting, for example a low-viscosity ceramic, which covers and is bonded to the surface 21 of the casting cores 2 and becomes stable with regard to casting by drying and/or heating. This subsequent coating 22 increases the size of contact areas of existing contact locations 11 between the casting cores 2 and may also create additional contact locations 18 with the outer sides of the casting cavity 1 or another casting core 2. In this way, the number of passages 3 formed therefrom is increased. Since the adhering coating 22 is thicker in the regions of the connection locations 11, on account of the surface tension, than in other regions, the passage width 16 becomes more uniform. The ceramic material which is used for coating is subsequently leached out of the cast workpiece 20 together with the casting cores 2.

Figure 2A:
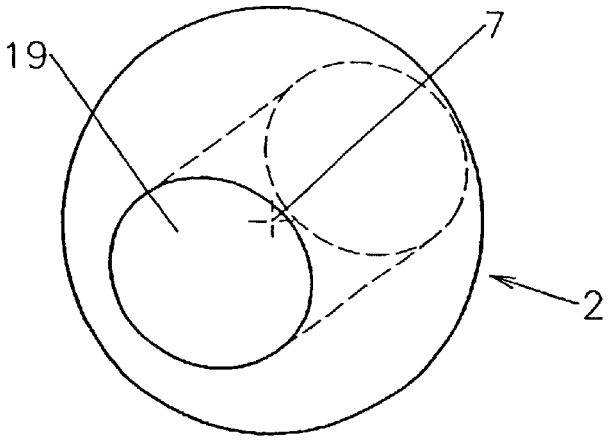

FIGS. 2*a, b, c* shows perspective views of various casting cores 2. The casting cores 2 have hollows. In FIG. 2*a*, the hollow runs in the form of a central bore 19 through the center 7 of a virtually spherical casting core 2. During casting, the bore 19 is filled with casting material, and when the surrounding casting core 2 is removed by leaching after the casting operation, a central strut of casting material remains in place, making a considerable contribution to the strength in this region. At the same time, the introduction of the hollow reduces the volume of the casting core in favor of the volume of casting material.

Figure 2C:
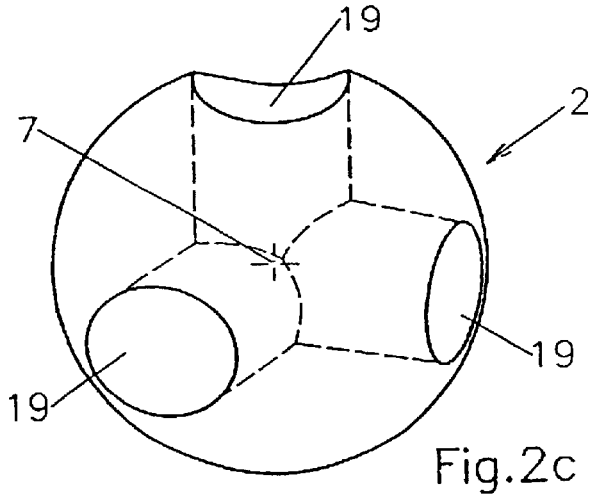
Figure 2B:
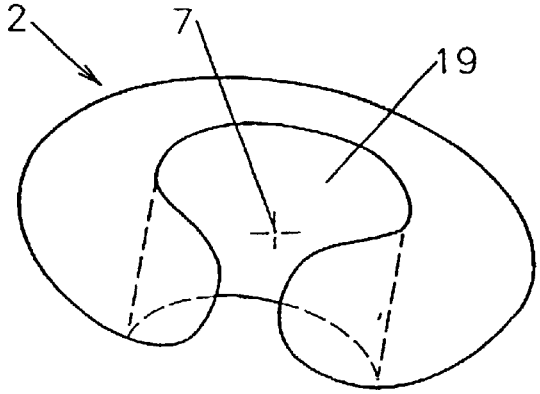

FIG. 2*b* shows an ellipsoidal, almost disc-like casting core 2 with a virtually central bore 19 which, however, has an additional opening on one side, resulting in the formation of a laterally open ring. In this way, casting material can penetrate more easily into the hollow in the form of the bore 19, and a lateral strut of casting material which provides additional stability is formed.

FIG. 2*c* shows a spherical casting core 2 with three central bores 19 which meet in the center 7 of the casting core 2. Therefore, casting material can penetrate into the casting core 2 from three sides, and consequently the core has a very large surface area and a very small volume, so that the stability of the workpiece 20 is increased.

To ensure that all the surfaces of the casting cores 2 and all the regions of the casting mold 10 are filled with casting material, the casting mold 10 is connected to an evacuation device, which is not shown. In this way, the casting material is drawn through the casting mold 10 into all the narrowest parts of the casting mold 10 between the casting cores 2.

FIG. 3 shows a section through an outer wall 14, which has passages passing through it, of a turbine blade or vane. The casting cores 2 have been leached out of the workpiece 20, and the cavities which remain are connected at the contact locations 11 between the casting cores 2, with the result that passages 3 which run through the outer wall 14 between the inner side 17 and outer side 15 are formed. The passages 3 are illustrated in simplified diagrammatic form in FIG. 3, for reasons of clarity. In principle, they are narrower and have more branches and openings 6. The passages 3 have different lengths and branches and, depending on the choice of size and shape of the casting cores 2, are arranged very close together at their openings 6 at the outer side 15. In this way, the film cooling can reach every region of the outer side 15 of the outer wall 14 of the turbine blade or vane, and sufficient cooling of the outer wall 14 is ensured even when small amounts of coolants are used.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for casting a workpiece, comprising:

introducing casting cores into a casting cavity; and producing passages from the casting cores, which pass through the workpiece, wherein the casting cores are introduced into the casting cavity in such a manner that they rest loosely against one another.

2. The process as claimed in claim 1, wherein the casting cores introduced into the casting cavity, are subsequently coated with a material which can withstand casting and bonds to them.

3. A process for casting a workpiece as claimed in claim 1, wherein the workpiece is an internally cooled turbine blade.

4. A process for casting a workpiece as claimed in claim 1, wherein the workpiece is an internally cooled turbine vane.

* * * * *